US009428872B2

(12) United States Patent
Neusch

(10) Patent No.: US 9,428,872 B2
(45) **Date of Patent: *Aug. 30, 2016**

(54) ANTI-RAM VEHICLE BARRIER SYSTEM

(75) Inventor: William H. Neusch, Marble Falls, TX (US)

(73) Assignee: BETAFENCE CORPORATE SERVICES NV, Ghent (BE)

( * ) Notice: Subject to any disclaimer, the term of this patent is extended or adjusted under 35 U.S.C. 154(b) by 332 days.

This patent is subject to a terminal disclaimer.

(21) Appl. No.: 12/856,916

(22) Filed: Aug. 16, 2010

(65) Prior Publication Data

US 2011/0062403 A1 Mar. 17, 2011

Related U.S. Application Data

(63) Continuation-in-part of application No. 12/813,457, filed on Jun. 10, 2010, and a continuation-in-part of application No. 12/057,181, filed on Mar. 27, 2008, now Pat. No. 8,083,433.

(60) Provisional application No. 61/234,118, filed on Aug. 14, 2009, provisional application No. 61/185,930, filed on Jun. 10, 2009, provisional application No. 60/908,391, filed on Mar. 27, 2007.

(51) Int. Cl.
*E01F 15/00* (2006.01)
*E01F 13/12* (2006.01)

(52) U.S. Cl.
CPC ..... *E01F 13/12* (2013.01)

(58) Field of Classification Search
CPC ..... E01F 13/12
USPC ..... 256/1, 13.1, 73; 404/6, 9–11
See application file for complete search history.

(56) References Cited

U.S. PATENT DOCUMENTS

| | | | | | |
|---|---|---|---|---|---|
| 1,857,435 | A | * | 5/1932 | Cole | 256/13.1 |
| 2,265,698 | A | * | 12/1941 | Opgenorth | 256/13.1 |
| RE22,060 | E | * | 4/1942 | Hayden et al. | 256/13.1 |
| 2,793,450 | A | * | 5/1957 | Williams | 49/30 |
| 3,210,051 | A | * | 10/1965 | Case | 256/13.1 |
| 3,665,587 | A | * | 5/1972 | Michaelsen | 29/461 |
| 3,839,824 | A | * | 10/1974 | Ellis et al. | 49/34 |
| 3,990,182 | A | * | 11/1976 | Linder | 49/34 |
| 4,638,597 | A | * | 1/1987 | Lybecker | 49/340 |
| 5,039,066 | A | * | 8/1991 | Stacey | 256/13.1 |
| 5,118,056 | A | * | 6/1992 | Jeanise | 246/127 |
| 5,282,336 | A | * | 2/1994 | Tucker | 49/21 |
| 5,332,071 | A | * | 7/1994 | Duncan | 188/371 |
| 5,762,443 | A | * | 6/1998 | Gelfand et al. | 404/6 |
| 6,065,738 | A | * | 5/2000 | Pearce et al. | 256/13.1 |
| 6,131,873 | A | * | 10/2000 | Blazon et al. | 248/548 |
| 6,840,194 | B2 | * | 1/2005 | Young | 119/513 |

(Continued)

*Primary Examiner* — Gregory Binda
*Assistant Examiner* — Nahid Amiri
(74) *Attorney, Agent, or Firm* — Symbus Law Group, LLC; Clifford D. Hyra

(57) ABSTRACT

An anti-ram vehicle barrier system adapted to arrest an impacting vehicle of substantial mass within a selected distance of the barrier. The barrier system includes a fence portion and/or a gate for selectively allowing passage through an entry port. The fence portion includes a pair of terminal posts positioned in and secured to the ground in a spaced apart relationship and cables connected between the terminal posts. The gate includes a cable extending across a panel that is connected on opposing ends to opposing posts positioned on opposite sides of the entry point. For passage the panel is moved relative to the posts and to the ground.

19 Claims, 9 Drawing Sheets

(56) References Cited

U.S. PATENT DOCUMENTS 6,843,613 B2 * 1/2005 Gelfand et al. ..... 404/6
6,902,151 B1 * 6/2005 Nilsson ..... 256/13.1
2002/0014620 A1 * 2/2002 Nilsson ..... 256/59
2003/0213946 A1 * 11/2003 Alberson et al. ..... 256/13.1
2003/0222254 A1 * 12/2003 Bergendahl ..... 256/13.1
2005/0063777 A1 * 3/2005 Smith et al. ..... 404/6

* cited by examiner

ANTI-RAM VEHICLE BARRIER SYSTEM

RELATED APPLICATIONS

This application is a non-provisional patent application of Ser. No. 61/234,118, filed on Aug. 14, 2009.

This application is a continuation-in-part of Ser. No. 12/813,457, filed on Jun. 10, 2010, which is a non-provisional patent application of Ser. No. 61/185,930, filed on Jun. 10, 2009.

This application is a continuation-in-part of Ser. No. 12/057,181, filed on Mar. 3, 2008, now U.S. Pat. No. 8,083,433, which is a non-provisional patent application of Ser. No. 60/908,391, filed Mar. 27, 2007, all of which are incorporated herein by reference.

TECHNICAL FIELD

The present disclosure relates in general to barriers to vehicular traffic and more specifically to an above grade, barrier to arrest a vehicle that attempts to breach the barrier by ramming the vehicle into the barrier.

BACKGROUND

This section provides background information to facilitate a better understanding of the various aspects of the present invention. It should be understood that the statements in this section of this document are to be read in this light, and not as admissions of prior art.

Vehicle barrier systems are utilized to guard against access to protected areas. In particular, the systems are provided to stop motor vehicles, such as trucks, from being intentionally driven into certain areas for nefarious purposes. At least one agency of the United States Government has provided standards to certify barriers for use. Heretofore, it has commonly been believed that vehicle systems must be so called mass-to-mass systems, wherein the barrier comprises structures of great mass to counteract the mass and kinetic energy of the impacting vehicle.

SUMMARY

According to one or more aspects of the invention an anti-ram vehicle barrier system for arresting an impacting vehicle of substantial mass within a selected distance of the barrier comprises a pair of terminal posts positioned in and secured to the ground in a spaced apart relationship; at least three cables, each cable having opposing terminal ends connected respectively to each of the terminal posts, the at least three cables held in tension a distance above a grade of the ground and vertically spaced apart from one another in relation to the grade; and a line post secured in the ground and positioned between the pair of terminal posts, the line post holding a portion of each of the cables.

According to one or more aspects the anti-ram vehicle barrier system includes a gate for arresting an impacting vehicle of substantial mass within a selected distance of the barrier. According to one or more aspects of the invention the gate comprises a cable extending across a panel, the panel movable between a closed position blocking an entry port and an open position; a first post secured in the ground on a first side of the entry port, wherein a first end of the panel is connected to the first post; and a second post secured in the ground on a second side of the entry port, wherein the second end of the panel is connected to the second post. According to at least one embodiment, the panel is moved laterally relative to the ground to open and close the gate. According to some embodiments, the panel is moved vertically relative to the ground to open and close the entry point. In some embodiments, the panel is moved to a position below the ground level when the entry port is opened.

A method according to one or more aspects of the invention of arresting a vehicle of substantial mass from penetrating into a protected area comprises providing a barrier fence, the barrier fence comprising a pair of terminal posts positioned in and secured to the ground in a spaced apart relationship and a cable having opposing terminal ends connected respectively to each of the terminal posts, the cable held in tension a distance above a grade of the ground between the pair of terminal posts and a gate; impacting a motor vehicle having a substantial mass and moving at a rate of speed into the barrier fence; and stopping penetration of an identified portion of the vehicle from extending a selected distance beyond the cable.

The foregoing has outlined some of the features and technical advantages of the invention in order that the detailed description of specific embodiments of the invention that follows may be better understood. Additional features and advantages of the invention will be described hereinafter which form the subject of the claims of the invention.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
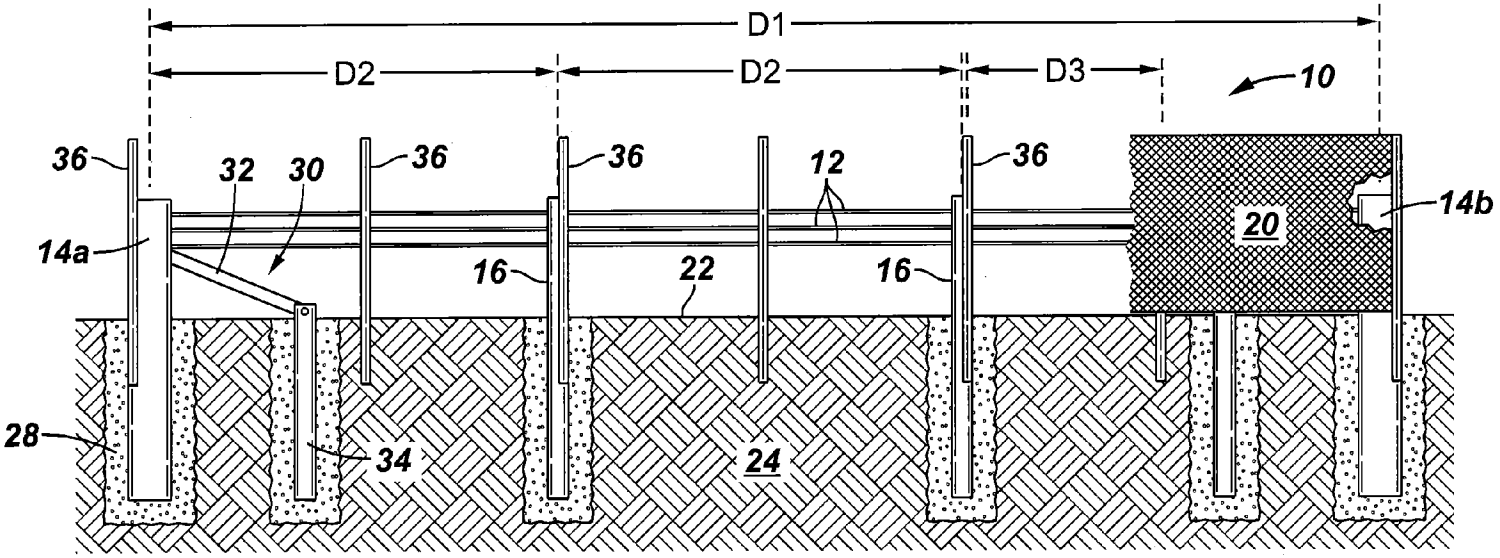
FIG. 1 is an elevation view of an embodiment of a vehicle barrier fence according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
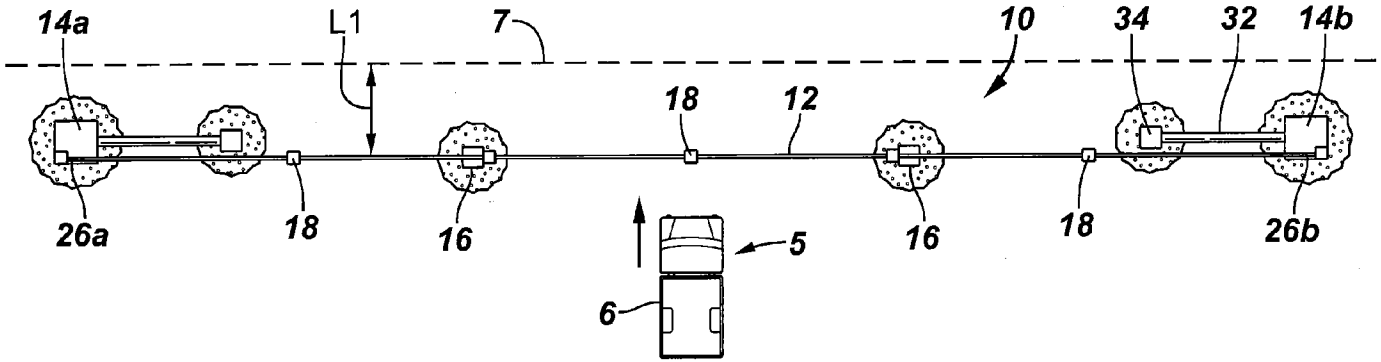
FIG. 2 is a plan view of an embodiment of the vehicle barrier fence of FIG. 1.

FIG. 1 is an elevation view of an embodiment of a vehicle barrier of the present invention generally denoted by the numeral 10. FIG. 2 is a plan view of barrier fence 10 depicted in FIG. 1. FIG. 2 further illustrates a motor vehicle 6, depicted as a truck having a bed 6, moving in the direction of the arrow toward barrier fence 10. The hatched line 7 represents a distance L1 of 36 inches from barrier fence 10. In the depicted embodiment, vehicle 5 has a mass of 15,000 pounds.

The depicted embodiment is of a longitudinal barrier fence 10, or a portion of a barrier fence. The depicted and described embodiments are for a "K12" rated vehicle barrier. K12 refers to a certification class for the United States Department of State. A K12 rating, or certification, requires that the barrier must prevent the bed of a 15,000 pound (6810 kg) truck, traveling at the speed of 50 miles per hour (80 kilometers per hour) from penetrating the barrier more than 36 inches (55 cm) indicated as "L1" in FIG. 2. Barrier fence 10 is also adapted for stopping vehicle 5 within the limits of L1 when traveling 30 miles per hour (48 kph) and 40 mph (65 kph) for obtaining a K4 and a K8 certification respectively. Unexpectedly, a barrier fence corresponding to an embodiment of the present disclosure has been shown to meet the criteria for a K12 certification. Barrier fence 10 is not a mass to mass type barrier that is commonly utilized to achieve the standards necessary for a United States Department of State certification.

Referring to the embodiments of FIGS. 1 and 2, barrier fence 10 includes cables 12, terminal posts 14, and line posts 16. Barrier fence 10 may further include one or more cable spacing members 18 and/or a security fencing generally denoted by the numeral 20. In FIG. 1, fencing 20 is depicted as chain link, although other fencing materials including without limitation barb wire, razor wire, wood fencing, and iron. Fencing 10 may be provided to limit or prevent passage of pedestrians, provide an aesthetic covering, or to conceal the vehicle barrier system.

For purposes of brevity and clarity, barrier fence 10 is described herein with reference to a fence or section of fence extending between opposing terminal posts 14. "Terminal" is utilized herein in designating posts to which the terminal end of a cable 14 is connected. Terminal posts 14, as described further below, may be positioned along a longitudinal section or portion of barrier fence 10 or be a corner post. Corner terminal posts are generally utilized for changes of direction in the section of fence. For example, it may be desired to utilize a corner terminal post for a change in direction of cable 12 of greater than about 15 degrees. As will be readily understood, a terminal post 16 may be an "in-line" post wherein the terminal end of a first cable 12 extending a first direction is connected and the terminal end of a second cable 12 that extends a different direction from the first direction (for example 180 degrees) is connected.

Referring now to the embodiment depicted in FIGS. 1 and 2, three cables 12 extend between opposing terminal posts 14*a*, 14*b*. Cables 12 are vertically spaced apart from one another relative to the grade 22 of ground 24. For example, in FIG. 1 each of the cables 12 are spaced approximately 6 inches (9 cm) from one another and the lowest cable 12 is spaced about 20 inches (30.8 cm) from grade 22.

Each cable 12 has opposing terminal ends, generally denoted by the numeral 26, and identified separately as ends 26*a*, 26*b*. Each terminal end 26 is connected to terminal post 14. As will be further described below, terminal end 26 is hingedly connected to terminal post 14 in the embodiments of FIGS. 1 and 2. In the depicted embodiment, terminal posts 14*a* and 14*b* are spaced apart a distance D1. D1 corresponds to the length of cable 12 when it is pulled taught and in position for arresting an impacting motor vehicle. For example, a wire cable 12, having tensile strength of approximately 40,000 pounds (88,000 kg) may span distance D1 when tensioned to about 500 pounds (1,100 kg). In the depicted embodiment, D1 is no greater than about 2,000 feet (609 m).

Terminal posts 14 are secured into ground 24 by securing means 28. In the depicted embodiments, securing means 28 is reinforced concrete. Terminal post 14 may further be secured and stabilized by an anchor mechanism 30. Anchor mechanism 30 may include a cross-member 32 secured between terminal post 14 and an anchor 34 positioned in ground 24. In the depicted embodiment, anchor 34 is spaced approximately eight feet from terminal post 14 and secured in ground 24 by reinforced concrete. Cross-member 32 is a metal tube.

Figure 7:
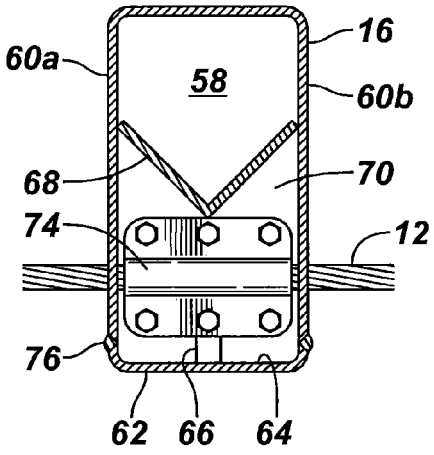
FIG. 7 is a plan view of an embodiment of a line post according to one or more aspects of the present disclosure.
Figure 8:
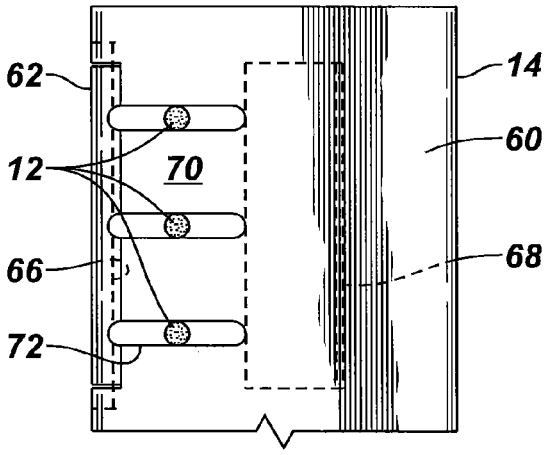
FIG. 8 is an elevation view of a portion of the line post of FIG. 7.

Positioned between terminal posts 14 are one or more line posts 16 which are spaced apart a distance D2. One or more line posts 16, described further with reference to FIGS. 7 and 8, are positioned between terminal posts 14. Line posts 16 are positioned and secured in ground 24 by a securing means 24. Line post 16 is operationally connected to cables 12 in a manner to absorb energy from an impacting vehicle and reduce the force that must be absorbed by terminal posts 14 and the cable to terminal post connections. In the depicted embodiments, line posts 16 are spaced from one another no more than about 20 feet (6 m). As will be described further below, cable 12 does not terminate at line posts 16 but is in operational connection to line posts 16.

Cable spacing members 18 are depicted in FIG. 2 connected to cables 12 and along the span of cables 12. Spacing members 18 tend to maintain cables 12 in a spaced apart relationship when impacted by a vehicle, and therefore maintain contact with the vehicle. Various mechanisms may be utilized to space cables 12 vertically apart, such as but not limited to the embodiment depicted in FIG. 9. Spacing mechanisms 18 may be independently connected to cables 12 or interconnect cables 12 and a post member.

Figure 9:
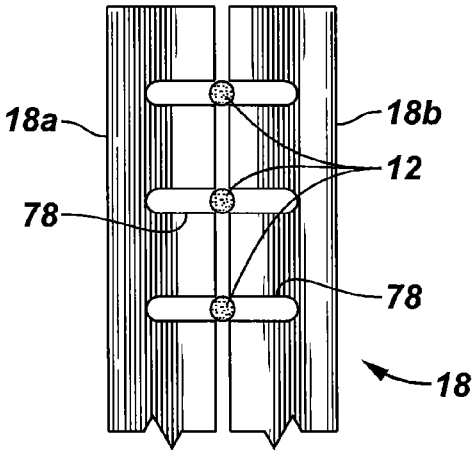
FIG. 9 is an elevation view of an embodiment of a cable spacer mechanism according to one or more aspects of the present disclosure.

For example, with reference to FIG. 1, spacers 18 may be connected to intermediate posts 36. Intermediate posts 36 are, in this embodiment, tubular posts that are positioned into ground 24. Posts 36 are not necessarily secured in ground 24. In the depicted embodiments, posts 36 are provided for erecting fencing 20 and provide an additional structure to cooperate with spacing members 18. Spacing members 18 and intermediate posts may be evenly spaced from one another, for example, by the distance D3 which is approximately 10 feet (3 m) in these embodiments. Cables 12 may be spaced apart, for example, by securing each cable to posts 36 in a spaced apart relationship by a U-bolt or other suitable connector. It is envisioned that a spacing mechanism 18, such as depicted in FIG. 9, that is solely connected to cables 12 may facilitate the maintenance of the desired spacing during impact by a vehicle.

Figure 3:
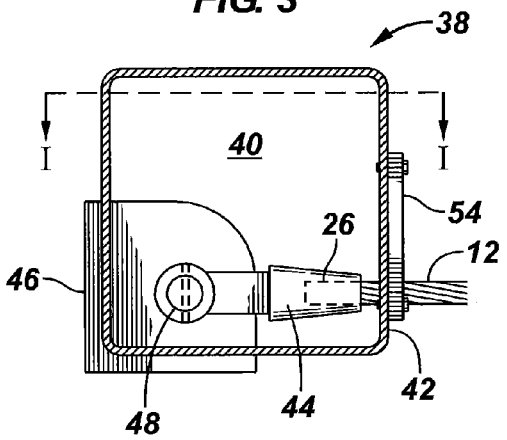
FIG. 3 is a plan view of an embodiment of a terminal post according to one or more aspects of the present disclosure.

Refer now to FIG. 3, wherein an embodiment of a terminal post-cable connection, generally denoted by the numeral 38, is shown. First, terminal post 14 is a tubular member having an internal cavity 40 and a face portion 42. Face portion 42 is a portion of the wall of tubular post 14 that is facing the direction in which a cable 12 extends, or the portion through which cable 12 extends. In the depicted embodiments, post 14 is depicted as a square or rectangular member, although other geometric shapes may be utilized. For example, terminal post 14 may be circular or triangular as well.

In the embodiment of FIG. 3, a terminal post-cable connector 38 includes a spelter socket 44 and plate 46. In this embodiment, terminal end 26 is connected within spelter socket 44, for example with zinc or an epoxy resin, and hingedly connected to plate 46 by pin or shaft 48. Plate 46 is connected to the body of terminal post 14 with cable 12 extending outward from face portion 42. In the depicted embodiment, spelter socket 44 and terminal end 26 are substantially positioned in cavity 40.

Figure 4:
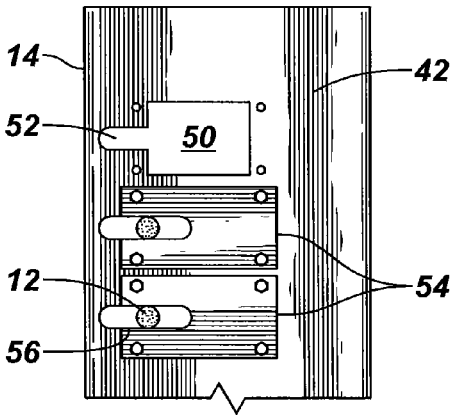
FIG. 4 is an elevation view of an embodiment of a portion of a terminal post according to one or more aspects of the present disclosure.

Refer now to FIG. 4, wherein a face portion 42 of a terminal post 14 is depicted having a slot 56 for passing cable 12. Slot 56 is a transverse slot that is substantially parallel with the grade and perpendicular to the vertical extension of the post from the ground. Face portion 42 in the depicted embodiment includes a window 50 formed for each cable 12 and cable to post connector. Window 50 is provided as one manner of positioning connection 38 of FIG. 3 in cavity 40. An open leg or slot portion 52 is also formed through face portion 42 for positioning a cable 12. A cover 54 is provided for connecting over a portion of window 50 while providing an open slot 56 that includes leg 52. Slot 56, which is formed through face portion 42, provides for transverse or longitudinal movement of cable 12 during impact by a vehicle thereby limiting or avoiding impact of the cable along the physical body forming the slot.

Figure 5:
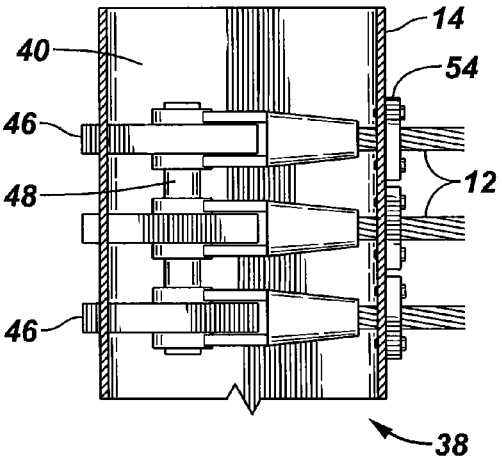
FIG. 5 is a view of a terminal post along the line I-I of FIG. 3.

Refer now to FIG. 5 wherein the terminal-post connection 38 is shown along the line I-I of FIG. 3. The cables 12 are spaced vertically apart from one another, relative to the ground, and interconnected by a shaft 48 in this embodiment.

Figure 6:
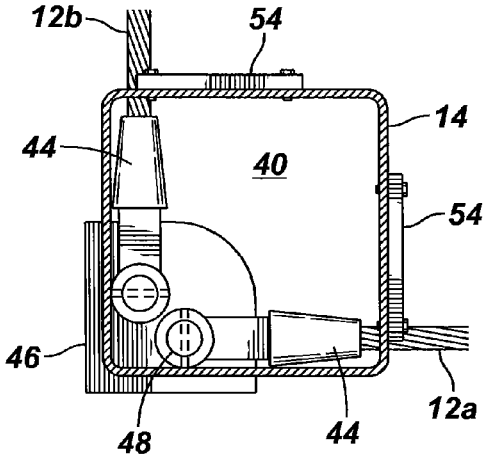
FIG. 6 is a plan view of an embodiment of a corner type terminal post according to one or more aspects of the present disclosure.

FIG. 6 is a plan view of an embodiment of a corner terminal post 14. In this embodiment, cable 12*a* is extending a direction substantially at a right angle to the direction of cable 12*b*. However, cables 12*a* and 12*b* may extend at varying angles from one another.

Refer now to FIGS. 7 and 8 wherein an embodiment of a line post 16 and a line post-cable connection are depicted. Line post 16 is depicted as a tubular post having an internal cavity 58. In this embodiment, line post 16 is a rectangular or square member having opposing sidewalls 60*a* and 60*b* and an interconnecting face plate 62. Face plate 62 includes an interior surface 64 directed into cavity 58. Positioned on interior surface 64 is a spacer member 66. Positioned in cavity 58 is a stop 68 that is spaced apart from spacer member 66 to form a trap 70. Thus, trap 70 is defined between spacer member 66, stop 68, and opposing sidewalls 60*a*, 60*b*. A slot or track 72 (FIG. 8) is formed through each opposing sidewall 60*a*, 60*b* for passing a corresponding cable 12.

Each cable 12 carries a clamping member 74. Clamping member 74 is secured to cable 12 and then positioned in trap 70 so as to be substantially held in place with regard to post 16. It is noted that in this embodiment, face plate 62 is connected between opposing sidewalls 60*a*, 60*b* by a connection means 76 such as welding. Face plate 62 is connected to opposing walls 60*a*, 60*b* after cable 12 and clamps 74 are positioned in cavity 58 and against stop 68. When face plate 62 is connected, cables 12 are positioned within tracks 72. Tracks 72, like terminal post slots 56 (FIG. 4), provide for movement of cable 12 when impacted by a vehicle while mediating damage to cable 12 by contact with the physical structure forming the slots.

Refer now to FIG. 9, wherein an embodiment of a cable spacing mechanism 18 is shown in isolation. In this embodiment, mechanism 18 is an elongated member formed in symmetrical longitudinal sections 18*a* and 18*b*. Each half includes a portion of a cable passage 78. Sections 18*a* and 18*b* are positioned together such that each passage 78 disposes a cable 12. Sections 18*a* and 18*b* may then be interconnected by welding or the like.

Figure 10:
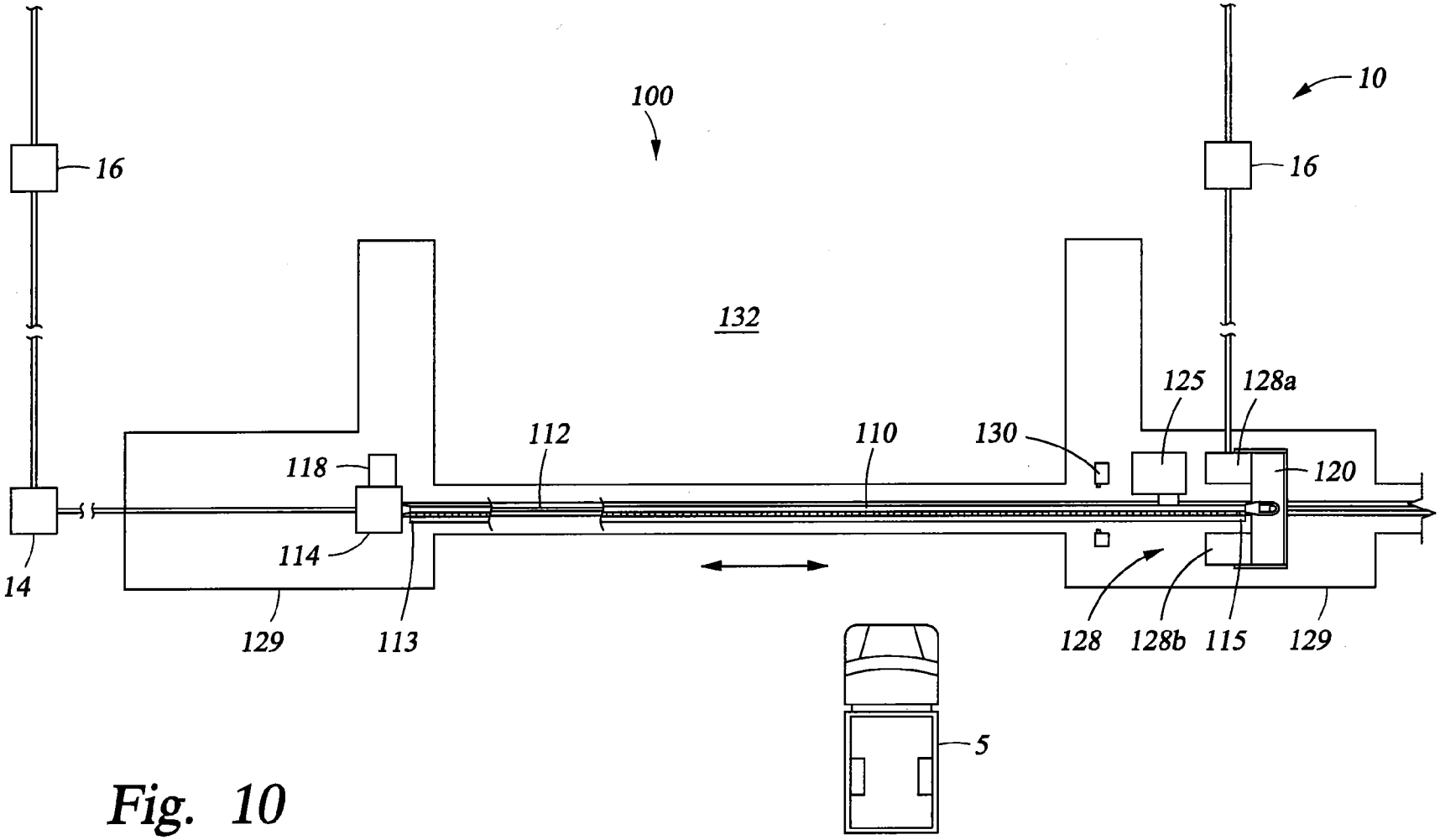
FIG. 10 is a plan view of an embodiment of a gate according to one or more aspects of the present disclosure.

FIG. 10 is a plan view of a gate assembly according to one or more aspects of the present disclosure generally denoted by the numeral 100. Assembly 100 comprises a gate 110 (e.g., panel) depicted in the closed position in FIGS. 10 and 11. Gate 110 comprises one or more elongated cables 112 which extend from a first end 113 to a second end 115. In the depicted embodiment, first end 113 is adapted to be releasably connected to latch post 114. Depicted in FIGS. 10 and 11, latch post 114 is immovably secured in the ground 99. Latch post 114 comprises a pin assembly 116 depicted in FIGS. 12A and 12B for releasably securing cables 112 to latch post 114 thereby securing gate 110 in the depicted closed position. An actuator 118, depicted in FIG. 10, may be connected with the pin assembly for operating the pin assembly 116 between the closed position (FIG. 12A) to the open position (FIG. 12B). As will be understood by those skilled in the art with the benefit of the present disclosure, pin assembly 116 may be operated via various mechanical systems and/or manually by an operator. Examples of actuator 118 include, without limitation, fluidic cylinders, electric motors and the like.

Figure 11:
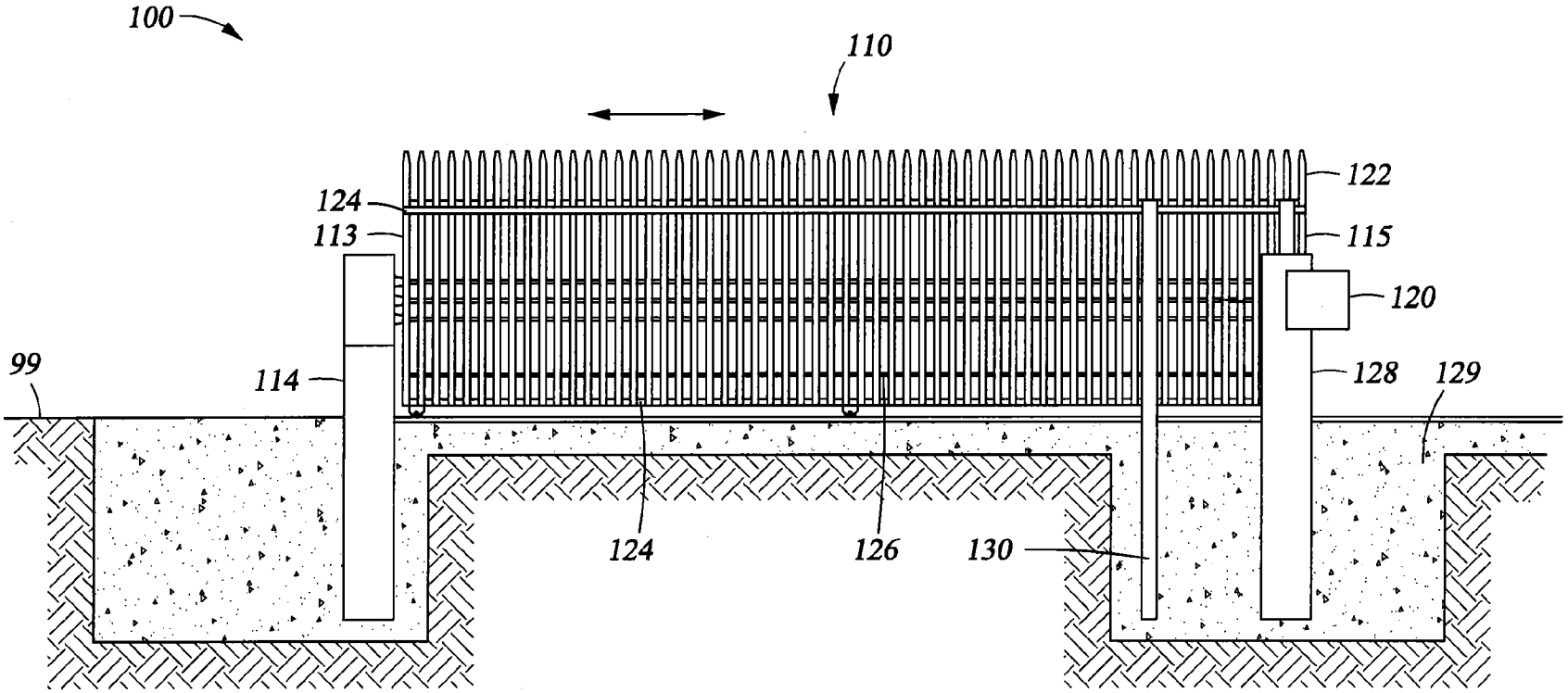
FIG. 11 is an elevation view of an embodiment of a gate according to one or more aspects of the present disclosure.
Figure 15:
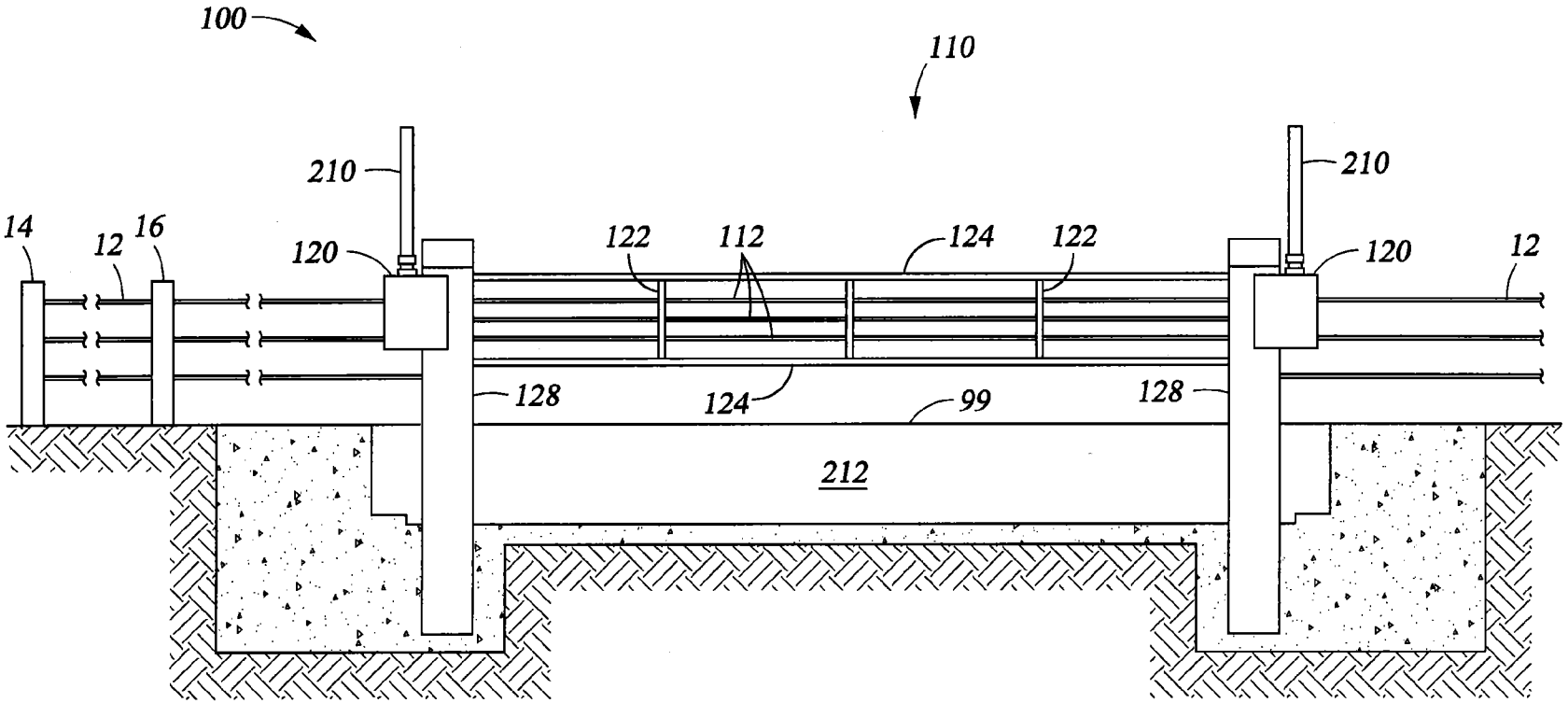
FIG. 15 is an elevation view of an illustrative embodiment of a pop-up gate according to one or more aspects of the present disclosure.

The second end 115 of cables 112 are connected to an end assembly 120, see FIGS. 10, 11, 13A and 13B for example. Depicted gate 110 further comprises two or more vertical members 122 (e.g., pickets). For example, as depicted in FIG. 11, gate 110 comprises a plurality of spaced apart vertically oriented pickets 122 interconnected by at least two horizontally (e.g., laterally) oriented members 124. A moving mechanism 125 (e.g., motor, actuator) can be connected to gate 110, for example via chain 126 (FIG. 11) to move gate 110 between the open and closed position. In this embodiment, gate 110 (e.g., panel) is moved laterally or horizontally relative to the ground. In some embodiments, for example as depicted in FIG. 15, gate 110 is moved vertically relative to the ground surface 99 (e.g., grade) between the open and closed positions.

According to one or more aspects of the present disclosure, end assembly 120 is adapted to engage a post device 128 when gate 110 is in the closed position. Depicted in FIGS. 10 and 11 post device 128 is depicted secured in ground 99, for example by concrete 129. In some embodiments, post device 128 can contain concrete 129. In the embodiment depicted in FIGS. 10-11, post device 128 is stationary and the end assembly 120 is moved laterally away, for example to the right in FIG. 11, from post device 128 when gate 110 is moved from the closed position as shown in FIGS. 10 and 11 to the open position. In one or more embodiments, gate assembly 100 may comprise a pop-up gate 110, depicted for example in FIG. 15 and further described below, wherein the panel is moved vertically relative to the posts on opposite ends of the entry port. In combination, post device 128 and end assembly 120, can be referred to as a post or as a hinge post.

Figure 14A:
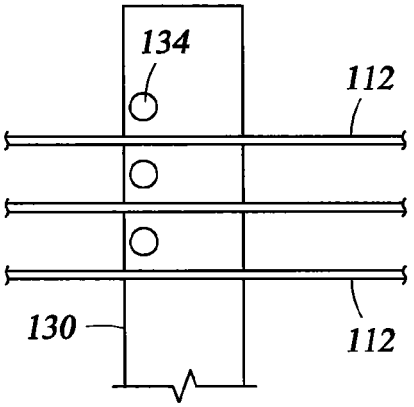
FIGS. 14A, 14B are schematic views of cable spacing according to one or more aspects of the present disclosure.
Figure 14B:
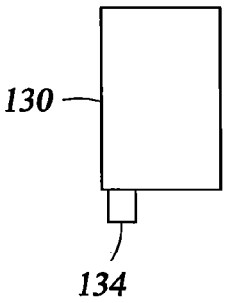

In the depicted embodiment, a support 130 is secured in ground 99, for example by concrete. Support 130 is depicted located between entry port 132 and post device 128 in the embodiment of FIGS. 10 and 11. Support 130 is shown located in FIG. 10 on the interior side of gate 110 such that gate 110 is between support post 130 and a vehicle 5 that is approaching entry port 132 from exterior gated area. Referring to FIGS. 14A and 14B, elements 134 can extend from support post 130 in a manner to space cables 112 from one another.

Figure 12A:
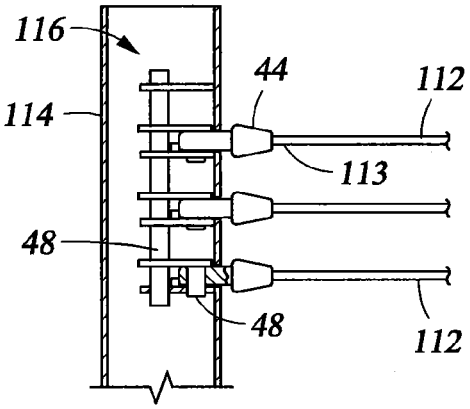
FIG. 12A is a schematic elevation view of a latch post according to one or more aspects of the present disclosure depicting terminals ends of cables secured to a latch post.
Figure 12B:
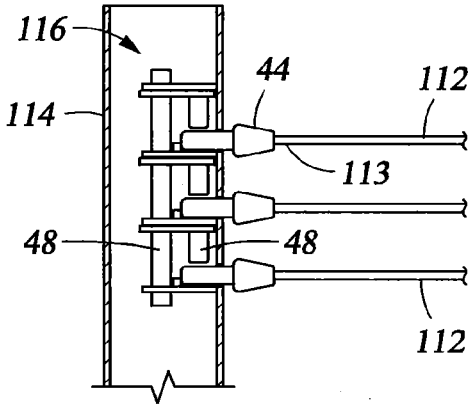
FIG. 12B is a schematic elevation view of a latch post according to one or more aspects of the present disclosure depicting terminals ends of cables disconnected from the latch post.

Refer now to FIG. 12A wherein the first ends 113 of cables 112 are shown connected and thus secured to latch post 114 and FIG. 12B wherein the first ends 113 of cables 112 are shown disconnected from latch post 114. In the depicted embodiments, connectors 44 (e.g., spelter sockets, cable clamps, etc.) are connected to ends 113 of cables 112. Pin assembly 116 is utilized to connect and secure connectors 44 and thus cables 112 to latch post 114.

Figure 13A:
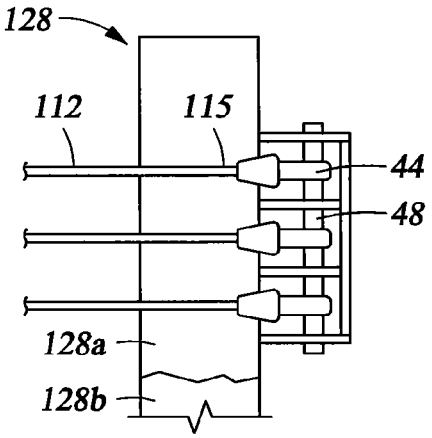
FIGS. 13A, 13B are schematic side and plan views of a post device according to one or more aspects of the present disclosure.
Figure 13B:
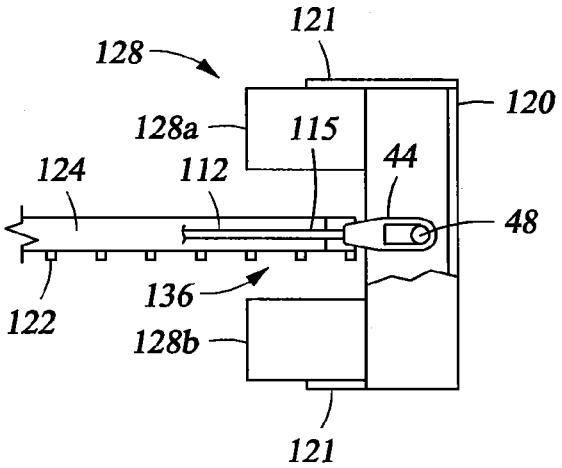

FIG. 13B is a plan view of post device 128 depicting the position of end assembly 120 when gate 110 is in the closed position according to one or more aspects of the present disclosure. Referring in particular to FIGS. 10, 11, 13B and 15, post device 128 comprises a pair of spaced apart members 128*a*, 128*b* defining a interior passage 136. Passage 136 is adapted to pass gate 110. As clearly depicted in FIG. 13B end assembly 120 can include members 121 for engaging post device 128. In the depicted embodiment, terminal end 115 of cable 112 is depicted connected to end assembly 120 via pin 48. Referring to the schematic elevation view of FIG. 13A, terminal ends 115 are depicted moveably, for example rotationally or hingedly connected to end assembly 120 and pin 48. In various embodiments, end assembly 120 is moveable relative to post device 128, for example, when gate 110 is moved between the open and closed position. For example, in the embodiment depicted in FIGS. 10 and 11, end assembly 120 is moved laterally to the right away from post device to open the gate, i.e., move gate 110 out of a position blocking entry port 132. In the embodiment further described below with reference to FIG. 15, end assemblies 120 positioned on opposing sides of entry port 132 and connected to opposing ends of cable 112 (e.g., gate 110) are moved vertically relative to post device 128.

Refer now to FIG. 15, wherein an illustrative embodiment of a pop-up gate according to one or more aspects of the present disclosure. In the depicted gate assembly 100, gate 110 is secured between two end assemblies 120. Similar to the embodiment described above with reference in particular to FIGS. 10, 11 and 13B, end assembly 120 is moveably disposed with post device 128. However, in the depicted pop-up embodiment, end assembly 120 is moveable relative to post device 128 vertically relative to ground level 99. In this embodiment, an actuator 210 (e.g., fluidic cylinder) is provided to move gate 110 between a position above ground 99 as depicted and below ground 99 wherein it is disposed in cavity 212. In some embodiments, gate 110 is not positioned below ground 99 when in the open positioned but raised above ground 99 a sufficient distance to permit passage through the entry port.

Figure 16A:
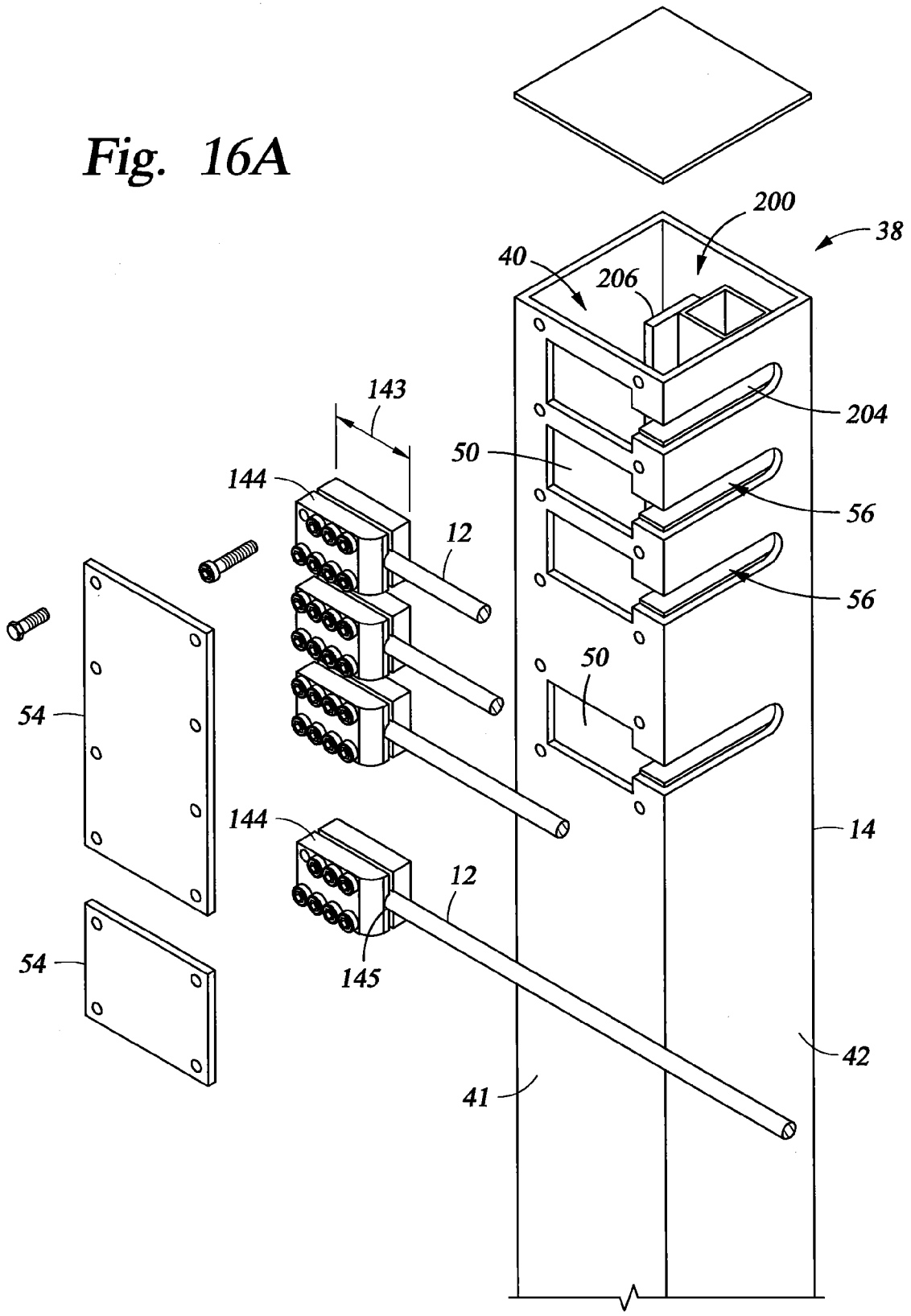
FIG. 16A is an exploded view of another embodiment of a terminal post according to one or more aspects of the present disclosure.
Figure 16B:
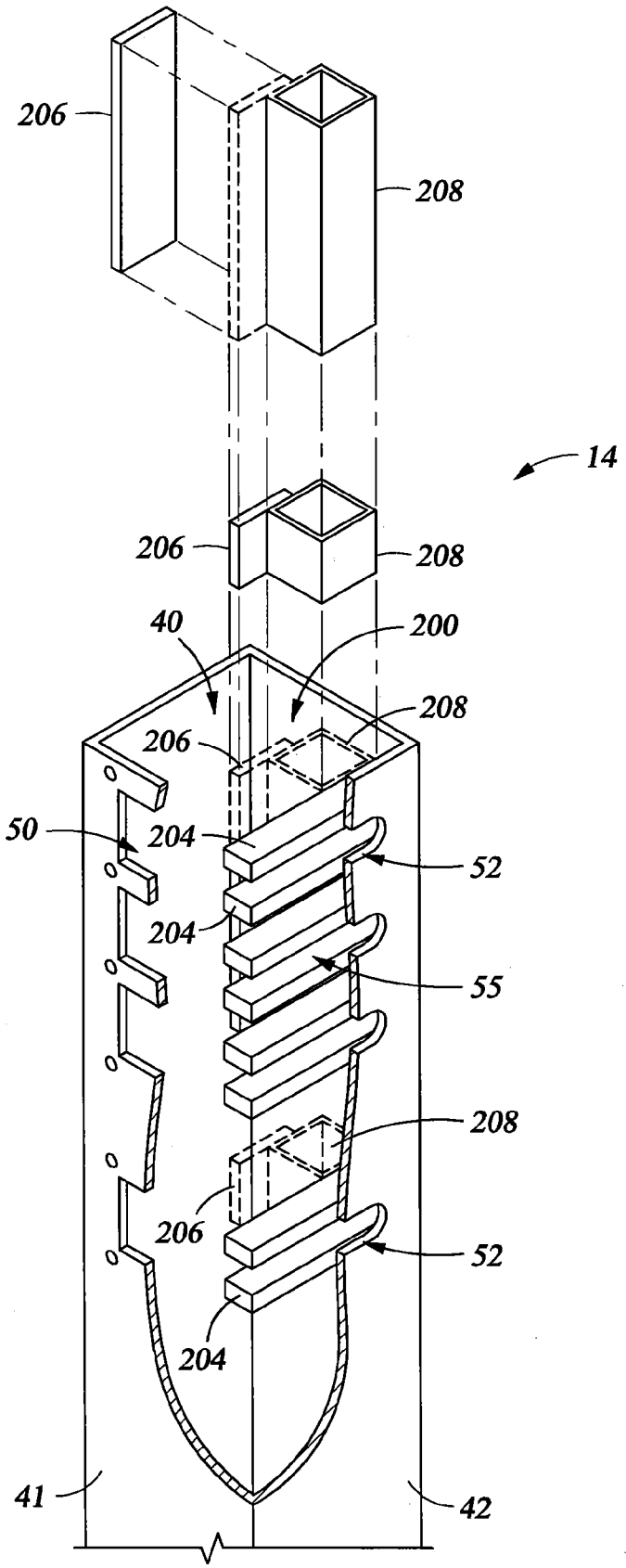
FIG. 16B is a cut-away view of the terminal post depicted in FIG. 16A.

Refer now to FIGS. 16A and 16B, wherein FIG. 16A is an exploded view of another embodiment of a terminal post 14 and terminal post-cable connection 38 and FIG. 16B is a cut-away schematic of terminal post 14. Depicted terminal post 14 is a tubular member having an internal cavity 40 and a face portion 42. Face portion 42 is a portion of the wall of tubular post 14 that is facing the direction in which a cable 12 extends. In the depicted embodiment, terminal post 14 is a square or rectangular member, although other geometric shapes may be utilized.

In this embodiment terminal post-cable connector 38 includes a cable clamp 144 (FIG. 16A) in which the terminal end of cable 12 is secured. In the depicted embodiment, each cable 12 is secured to a separate cable clamp 144. Each cable 12, when attached to terminal post 14, extends through a respective opening 56, referred to as a slot herein, formed through face 42. In the depicted embodiment, opening 56 is continuous with an opening 50, referred to herein as a window, formed through the side wall 41 adjacent to face 42. The continuous opening 50, 56 provides a passage for disposing and securing cable clamp 144 in cavity 40 of terminal post 14. A cover 54 can be secured to post 14 to cover and close window 50 when desired.

Terminal post-cable connector 38 further includes a frame 200 which secures each cable 12 in the desired position within the cavity 40 of terminal post 14. As will be understood by those skilled in the art with benefit of the present disclosure, frame 200 can be formed in one or more sections. Frame 200 is described herein with reference to a single cable 12 attachment. Frame 200 comprises a face unit 204 and an opposing back unit 206 which are spaced apart a distance substantially equal to the width 143 of cable clamp 144. In the depicted embodiment, frame 200 comprises a middle member 208 having a width substantially equal to width 143. Middle member 208 is disposed between face unit 204 and back unit 206. Depicted front unit 204 (comprising one or more sections) is disposed in cavity 40 and against the interior of face wall 42 with an opening 55 which is co-axial with opening 56 through face 42. According to one or more aspects of the present disclosure, front unit 204 spaces the intersection point 145 of cable 12 and clamp 144 away from post face 42.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A vehicle barrier system, the system comprising:

a first and a second elongated terminal post positioned in and secured to a ground in a spaced apart relationship;

three cables, each cable having a first terminal end connected the first terminal post and a second terminal end connected to the second terminal post, the three cables held in tension a distance above a grade of the ground and vertically spaced apart from one another in relation to the grade;

a line post secured in the ground and positioned between the first and the second terminal post, the line post holding a portion of each of the cables; and three open tracks formed by the line post, each of the open tracks being at least as long in a direction substantially perpendicular to the orientation of the line post as in a direction parallel to the orientation of the line post;

wherein each of the open tracks disposes one of the three cables.

2. The system of claim 1, further comprising a spacer mechanism connected to the three cables between the line post and one of the first and the second terminal posts, the spacer mechanism holding the three cables in a spaced apart relationship.

3. The system of claim 1, wherein each one of the first and the second terminal ends of each cable is hingedly connected to the respective one of the first and the second terminal posts via a spelter socket.

4. The system of claim 1, wherein the line post further comprises three pairs of open tracks, each pair of open tracks respectively extending through opposing sidewalls of the line post and aligned with one another, wherein each pair of open tracks disposes one of the three cables.

5. The system of claim 1, further comprising:

a spacer mechanism connected to the three cables between the line post and one of the first and the second terminal posts, the spacer mechanism holding the three cables in a spaced apart relationship.

6. The system of claim 1, wherein each one of the first and the second terminal ends of each cable is connected to the respective one of the first and the second terminal posts via a cable clamp socket.

7. The system of claim 1, wherein the first terminal end terminates at the first terminal post and the first terminal end is connected to the first terminal post by a device connected on the first terminal end and disposed within a cavity of the first terminal post.

8. The system of claim 7, wherein the device is a cable clamp socket.

9. A vehicle barrier, comprising:

a first terminal post and a second elongated terminal post positioned in and secured to a ground in a spaced apart relationship, the first and second elongated terminal posts extending vertically above the ground;

a cable having a first terminal end terminating at the first terminal post and connected to the first terminal post and a second terminal end terminating at the second terminal post and connected to the second terminal post, the cable held in tension between the first and the second terminal post a distance above the grade of the ground in a manner such that an identified portion of an impacting vehicle is stopped within a selected distance of the cable;

a line post positioned between the first terminal post and the second terminal post, the line post holding a portion of the cable; and an open track formed by the line post, the open track being at least as long in a direction substantially perpendicular to the orientation of the line post as in a direction parallel to the orientation of the line post;

wherein the open track disposes the cable.

10. The vehicle barrier of claim 9, wherein the first terminal end of the cable is hingedly connected to the first terminal post.

11. The vehicle barrier of claim 9, wherein the cable is disposed through a slot formed through the line post, wherein the slot is not open at a top end of the post.

12. The vehicle barrier of claim 9, comprising a device attached on the first terminal end of the cable and disposed within a cavity of the first terminal post.

13. The vehicle barrier of claim 9, wherein the open track is a transverse slot formed through the line post and substantially perpendicular to a vertical axis of the line post.

14. A vehicle barrier, comprising:

a first elongated terminal post and a second elongated terminal post positioned in and secured to a ground in a spaced apart relationship, the elongated terminal posts extending vertically above the ground;

a cable having a first terminal end terminating at and connected to the first elongated terminal post and a second terminal end terminating at and connected to the second elongated terminal post, the cable held in tension between the first and the second elongated terminal post a distance above the grade of the ground in a manner such that an identified portion of an impacting vehicle is stopped within a selected distance of the cable;

a line post positioned between the first elongated terminal post and the second elongated terminal post, the line post comprising an internal cavity and an opening formed through opposing sidewalls of the line post, the cable extending through the opening, wherein the opening does not extend to a top end of the line post; and an open track formed by the line post, the open track being at least as long in a direction substantially perpendicular to the orientation of the line post as in a direction parallel to the orientation of the line post;

wherein the open track disposes the cable.

15. The vehicle barrier of claim 14, further comprising:

a stop positioned in the internal cavity of the line post;

a trap formed in the internal cavity between the opening formed through the opposing sidewalls and face of the line post; and a member secured to the cable, the member disposed in the trap.

16. The vehicle barrier of claim 13, comprising a device attached on the first terminal end of the cable and disposed within a cavity of the first terminal post.

17. The vehicle barrier of claim 14, comprising a device attached on the first terminal end of the cable and disposed within a cavity of the first terminal post.

18. The vehicle barrier of claim 17, wherein the device is a cable clamp socket.

19. The vehicle barrier of claim 14, wherein the open track is a transverse slot formed through the line post and substantially perpendicular to a vertical axis of the line post.

* * * * *